United States Patent [19]

Ohno et al.

[11] Patent Number: 5,062,806

[45] Date of Patent: Nov. 5, 1991

[54] ELECTRIC CONNECTOR

[75] Inventors: Akira Ohno, Tokyo; Kunihiko Muraoka; Wataru Nakazato, both of Gunma, all of Japan

[73] Assignees: Japan Aviation Electronics Industry, Limited; Fuji Jukogyo Kabushiki Kaisha, both of Japan

[21] Appl. No.: 628,335

[22] Filed: Dec. 14, 1990

[30] Foreign Application Priority Data

Dec. 19, 1989 [JP] Japan ..... 1-145461[U]

[51] Int. Cl.[5] ..... H01R 3/00

[52] U.S. Cl. ..... 439/490; 439/488; 439/352

[58] Field of Search ..... 439/488–490, 439/353, 350, 352, 709, 712, 716, 717

[56] References Cited

U.S. PATENT DOCUMENTS

| | | | |
|---|---|---|---|
| 3,960,428 | 6/1976 | Naus et al. | 439/490 |
| 3,969,609 | 7/1976 | Wanner et al. | 439/490 |
| 4,386,818 | 6/1983 | Millhimaes et al. | 439/490 |
| 4,878,853 | 11/1989 | Yamade et al. | 439/490 |

*Primary Examiner*—Larry I. Schwarta
*Assistant Examiner*—Hien D. Vu
*Attorney, Agent, or Firm*—Laff, Whitesel, Conte & Saret

[57] ABSTRACT

An electric connector comprised of a pin connector, socket connectors to be connected to the pin connector and a detection lever for detecting complete connection between the pin and socket connector. The detection lever has push rods operable on switch contacts arranged in the pin connector in electric connection to an indication circuit. When the detection lever is depressed under condition of complete connection, the push rods are allowed to open the switch contacts, i.e. the indication circuit which thereupon visually and/or audibly indicates presence of the complete connection.

7 Claims, 10 Drawing Sheets

ELECTRIC CONNECTOR

BACKGROUND OF THE INVENTION

The present invention relates to an improved electric connector, and more particularly relates to an electric connector provided with a detector for detecting connection between different electric elements such as a pin connector and a socket connector.

A conventional electric connector is typically made up of at least one socket connector, a pin connector having at least one receiving hole for the socket connector and a lock unit attached to the pin connector for firmly holding the two elements together after the initial connection. Holding by this lock unit is rather unreliable since application of an external force during use of the connector occasionally causes accidental separation of the two electric elements. In addition, unskilled manner of connection tends to result in incomplete connection between the pin connector and the socket connector.

In an attempt to prevent such unexpected separation during use, it is proposed to attach a detection lever to the pin connector and this detection lever is provided with a plurality of legs operably received in the receiving hole of the pin connector. When depressed, the legs extend into the receiving hole. Corresponding recesses are formed in the socket connector so that the legs of the detection lever should rest therein when socket connector is inserted in position into the receiving hole of the pin connector. As a consequence, complete insertion of the socket connector into the receiving hole automatically depresses the detection lever.

When the socket connector is incompletely inserted into the receiving hole of the pin connector upon depressing of the detection lever, one or all of the legs of the detection lever are out of correct engagement. The detection lever can be depressed completely when the pin connector is correctly received in the socket connector. In this case, this state of connection is visible from outside. Alternatively, the detection lever may be constructed so that it should generate a click when depressed.

In the case of these conventional systems, complete connection by the connector can be confirmed via sensuous perception only such as visual recognition, audible recognition and tangible recognition. In addition, it is next to impossible in the conventional art to constantly supervise the state of connection throughout the life of an electric connector and incomplete state of connection often causes malfunction and/or breakdown of an electric device or appliance for which the connector is used.

SUMMARY OF THE INVENTION

It is the basic object of the present invention to enable constant supervision of the state of connection of an electric connector via electric detection.

It is another object of the present invention to prevent malfunction and/or break-down of an electric device or appliance to be otherwise caused by incomplete locking by a detection lever.

It is the other object of the present invention to avoid dangers caused by malfunction and/or break-down of an electric device or appliance incorporating one or more electric connectors.

It is a further object of the present invention to enable electric detection of complete connection between a pin connector and a socket connector.

In accordance with the present invention, the electric circuit comprises at least one socket connector, a pin connector provided with at least one receiving hole adapted for receiving the socket connector, a detection lever provided with a plurality of legs extending towards the receiving hole and coupled to the pin connector in an arrangement such that the legs should intrude into the receiving hole to rest in a corresponding recess formed in the socket connector when the socket connector is completely received in the receiving hole of the pin connector and the detection lever is depressed against the pin connector, at least one switch contact arranged within the pin connector, and at least one push rod coupled to the detection lever so as to push and open the switch contact when the detection lever in depressed.

In one preferred embodiment, the pin connector is provided with a cavity accommodating the switch contact and a through hole communicating with the cavity, the push rod extends into the through hole, the switch contact includes a pair of leaf springs and a pair of opposed end contacts carried by the leaf springs, and the push rod is provided with an engage piece for engagement with hole ends of the through hole as well as a release head which intervene between the end contacts when the detection lever is depressed.

In another preferred embodiment, the switch contact is associated with an electric circuit, and the electric circuit included an indicator provided with a lamp for indicating the state of the end contacts of the switch contact.

In the other preferred embodiment, the electric circuit includes a buzzer which is energized at closure of the end contacts.

In a further preferred embodiment, the electric connector further comprises a lock unit which locks connection between the pin connector and socket connector.

DESCRIPTION OF THE PREFERRED EMBODIMENTS

Figure 1:
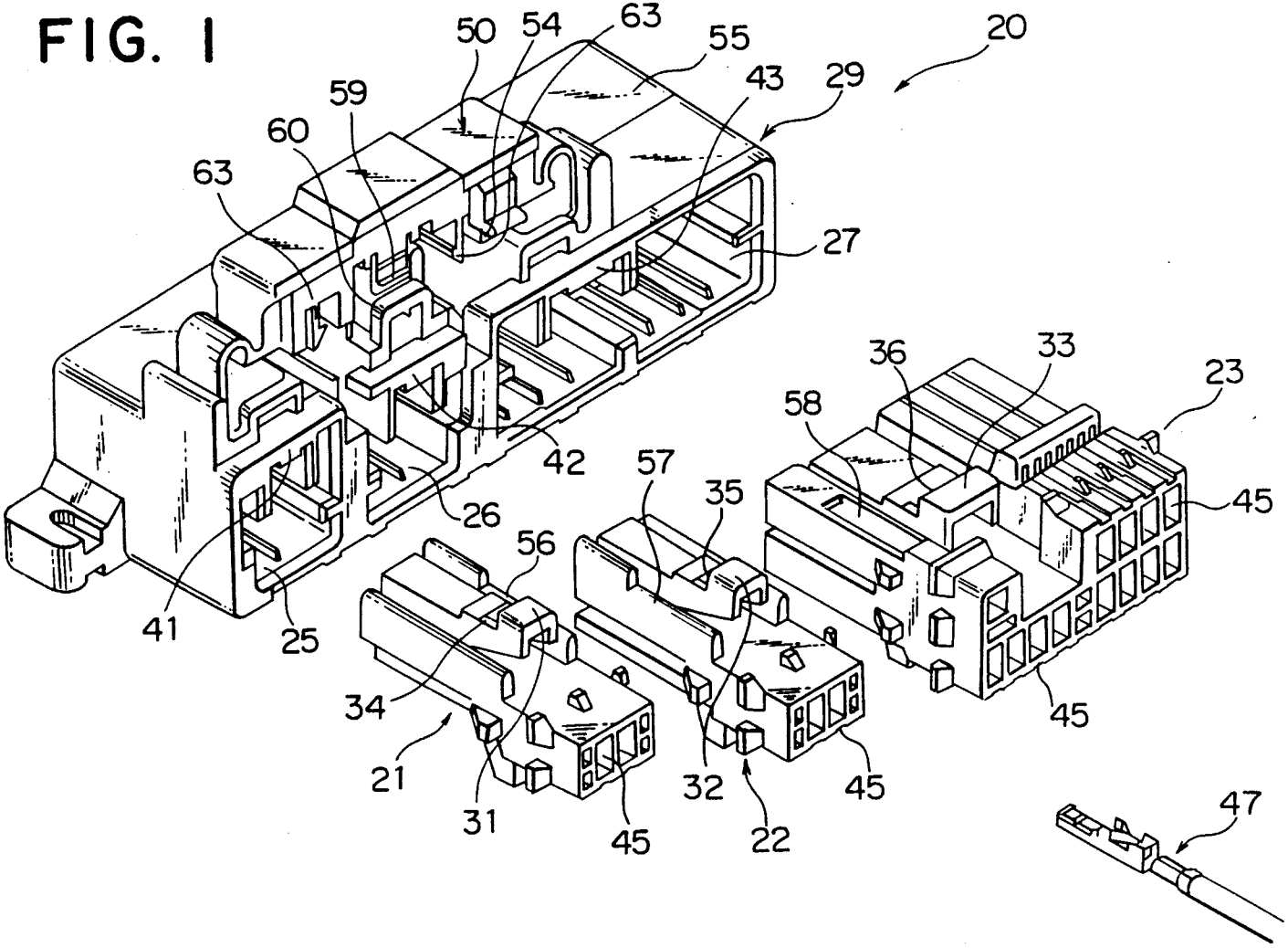
FIG. 1 is a perspective view of one typical example of a conventional pin connector and a socket connector under a separated condition.
Figure 2:
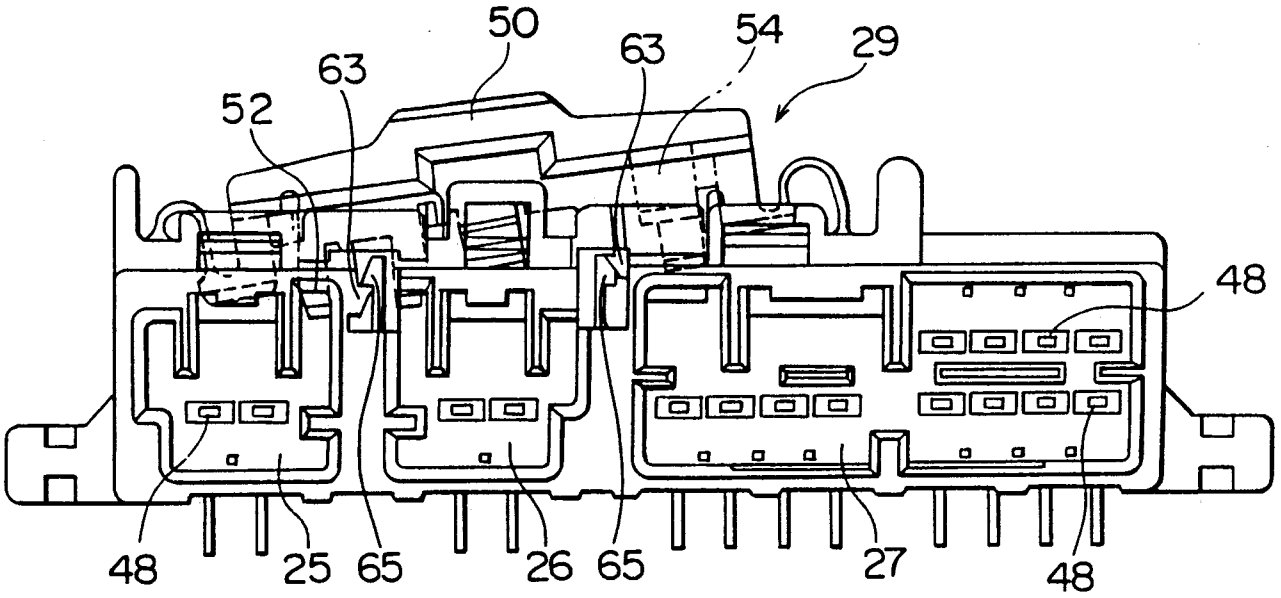
FIG. 2 is a front view of the pin connector shown in FIG. 1 with its detection lever in an incorrect engagement.
Figure 3:
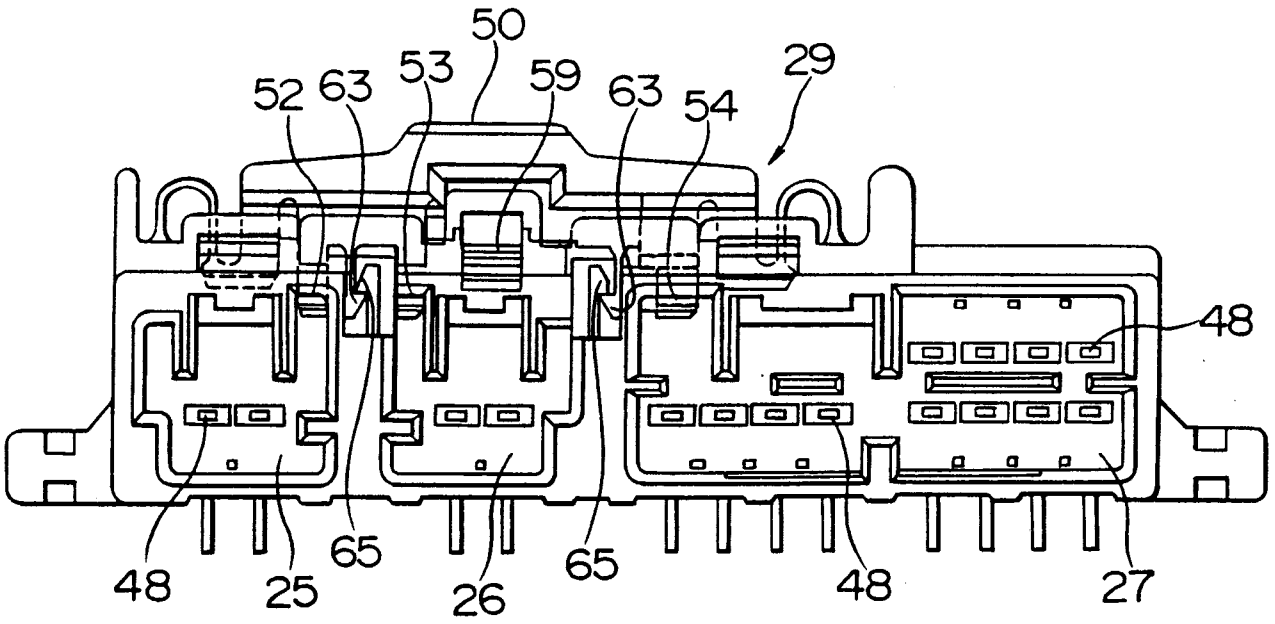
FIG. 3 is a front view of the same pin connector with its detection lever in the correct engagement.

One typical example of the conventional electric connector is shown in FIGS. 1 to 3, in which the connector 20 is comprised of a pin connector 29 and three socket connectors 21, 22 and 23.

The pin connector 29 is provided with three sets of like receiving holes 25, 26 and 27 for reception of the three socket connectors 21, 22 and 23, respectively. The connector 20 is provided with a lock unit for firmly holding the pin connector and the socket connector together after the initial connection. The lock unit includes locking windows 34, 35 and 36 associated with finger knobs 31, 32 and 33 on the socket connectors 21, 22 and 23. The lock unit further includes corresponding projections 41, 42 and 43 formed in the receiving holes 25, 26 and 27 in the pin connector 29. Upon complete connection of the pin connector 29 with the socket connectors 21, 22 and 23, the projections 41 to 43 on the pin connector 29 are brought into complete engagement with the locking windows 34 to 36 on the socket connectors 21 to 23. In this state of connection, electrically conductive socket contacts 47 provided in contact holes 45 in the socket connectors 21 to 23 come into individual connection with electrically conductive pin contacts 48 provided in the receiving holes 25 to 27 in the pin connector 29.

Holding by the lock unit, however, is quite vulnerable to accidental separation of the socket connectors 21 to 23 from the pin connector 29 on when any external force acts unexpectedly on the finger knobs 31 to 33 on the socket connectors 21 to 23. Further, the lock unit cannot prevent incomplete connection caused by unskilled manner of manual operation at connection.

In order to cover this defect, it is proposed to attach a detection lever 50 shown in FIG. 3 to the pin connector 29. This detection lever 50 is provided with three legs 52, 53 and 54 extending into the receiving holes 25 to 27 in the pin connector 29. Correspondingly, the socket connectors 21 to 23 are provided on their top faces with recesses 56, 57 and 58 at positions adapted for reception of the legs 52 to 54 when the socket connectors 21 to 23 are connected to the pin connector 29 and the detection lever 50 is depressed. The detection lever 50 is further provided with a downwardly projecting hook piece 59 which comes into engagement with a hook piece 60 formed on the top face 55 of the pin connector 29 when the detection lever 50 is depressed.

Upon depression of the detection lever 50 against the pin connector 29, its legs 52 to 54 tend to intrude into the corresponding recesses 56 to 58 in the socket connectors 21 to 23. When the socket connectors 21 to 23 are not in the correct connection with the pin connector 29, either or all of the legs 56 to 58 are not allowed to be received smoothly into the recesses 56 to 58. Whereas, when the socket connectors 21 to 23 are in the correct connection with the pin connector 29, the legs 56 to 58 are smoothly received in the recesses 56 to 58 in the socket connectors 21 to 23 as shown in FIG. 3. In other words, the detection lever 50 can be depressed without any resistance on the operator's hand, thereby providing a sort of tangible recognition by the operator. Resultant position of the detection lever 50 visually indicates presence of the correct connection between the pin connector 29 and the socket connectors 21 to 23, thereby providing a sort of visual recognition by the operator.

The illustrated example of the conventional connector 20 is further provided with a pair of hooking pawls 63 extending downwards from the detection lever 50 in an arrangement engageable with corresponding hooking pawls 65 formed on the pin connector 29. The hooking pawls 63 and 65 are both rendered elastic in material or construction so that their engagement should generate a click upon depression of the detection lever 50, thereby providing a sort of audible recognition by the operator.

As stated already, the conventional system for confirmation of presence of the correct connection in the connector is dependent upon sensual perception by the operator only, which is quite unreliable and, in addition, variable in degree of perception from operator to operator. Further, such a conventional system is quite unsuited for constant supervision of the connection during use of the connector.

One embodiment of the electric connector in accordance with the present invention is shown in FIG. 4 through 9, in which elements substantially same in function and/or construction as those used for the conventional example are indicated with same reference numerals.

Just as in the conventional example, the connector 20 is provided with three socket connectors 21 to 23, a pin connector 29 having receiving holes 25 to 27 adapted for receiving the socket connectors 21 to 23 and a detection lever 50 coupled to the pin connector 29. The detection lever 50 is coupled to the top face 55 of the pin connector 29 by means of a pair of holder blocks 66 each of which has an inverted U-shape and is made of an elastic material. Thus, the detection lever 50 is movable with respect to the top face 55 of the pin connector 29 and, before complete engagement, held slightly above the top face 55 by the elastic force of the detection lever 50. The detection lever 50 is provided with three legs 52, 53 and 54 which extend into the receiving holes 25 to 27 in the pin connector 29.

The receiving holes 25 to 27 are internally provided with recesses 56, 57 and 58 adapted for reception of the points of the legs 52 to 54 when the socket connectors 21 to 23 are placed into complete connection with the pin connector 29, thereby allowing depression of the detection lever 50 in the completely connected position.

Figure 9:
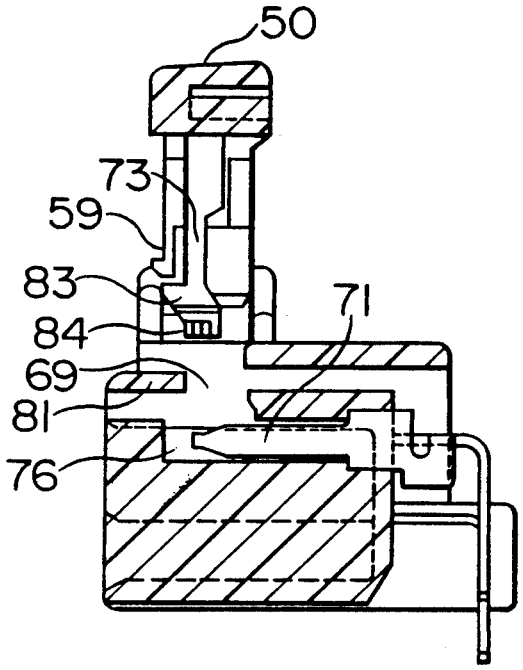
FIG. 9 is a cross-section taken along a line IX—IX in FIG. 5.

A cavity 76 is formed in the pin connector 29 at a position separate from the receiving holes 25 to 27 and a pair of electrically conductive switch contacts 71 are placed within the cavity 76 as shown in FIG. 9 wherein only one of the switch contacts is illustrated. The detection lever 50 is provided with a pair of springy push rods 73 and 74 which, when the detection lever 50 is depressed, press the switch contacts 71 to open it.

Figure 10:
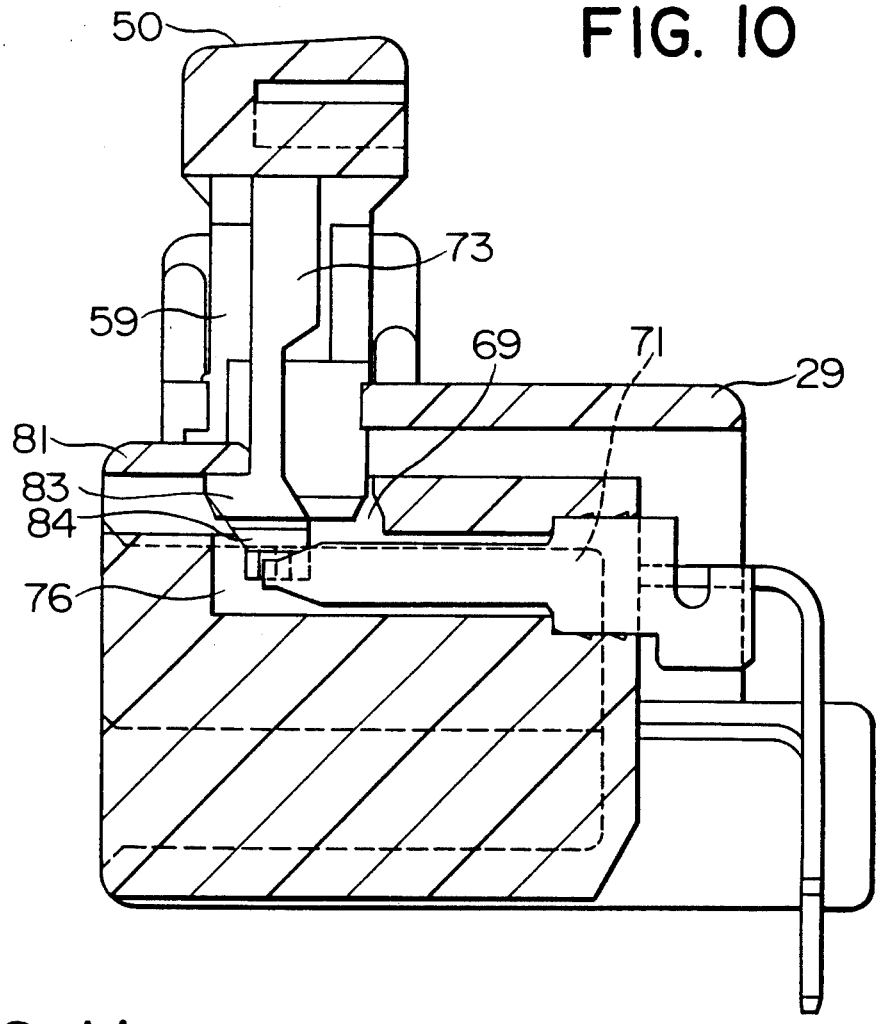
FIG. 10 is a sectional view of a switch contact with the detection lever being depressed.
Figure 11:
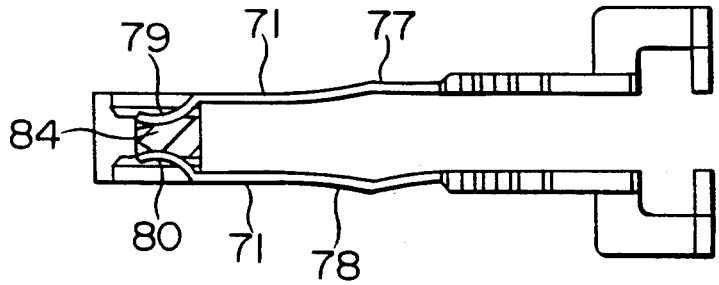
FIG. 11 is a sectional view of the switch contact with the detection lever being inserted.

More specifically as shown in FIGS. 10 and 11, the pin connector 29 is provided, in addition to the cavity 76 for accommodating the switch contact 71, with a through hole 69 communicating the cavity 76 to the outside of the pin connector 29. When the detection lever 50 is depressed, its push rods 73 and 74 intrude into the through hole 69. Each push rod 73 or 74 is provided with an engage piece 83 adapted for engagement with hole ends 81 and 82 of the through hole 69 as well as a release head 84 formed near the engage piece 83. As best seen in FIG. 11, one switch contact 71 is comprised of a leaf spring 77 associated with an end contact 79. Likewise, the other switch contact 71 is comprised of a leaf spring 78 with an end contact 80 opposed to the end contact 79 of the one switch contact 71.

As the detection lever 50 is depressed, the push rods 73 and 74 intrude into the through hole 69 and the release head 84 intervenes between the end contacts 79 and 80 of the switch contact 71 to open it with the engage piece 83 in engagement with the hole ends 81 and 82.

Figure 12:
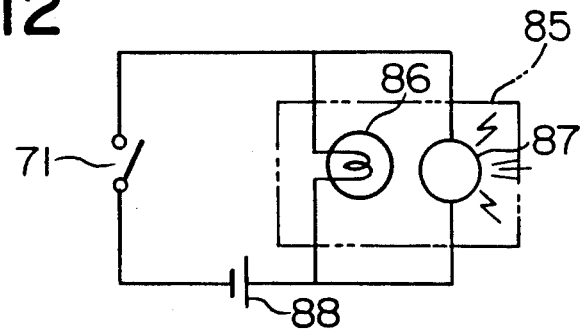
FIG. 12 is a circuit diagram of an electric circuit connected to the switch contact.

The switch contact 71 is associated with an electric circuit shown in FIG. 12, in which the circuit includes a battery 88 and a switch indicator 85 provided with a lamp 86 for visual indication and a buzzer 87 for audible indication of the state of the switch.

Figure 4:
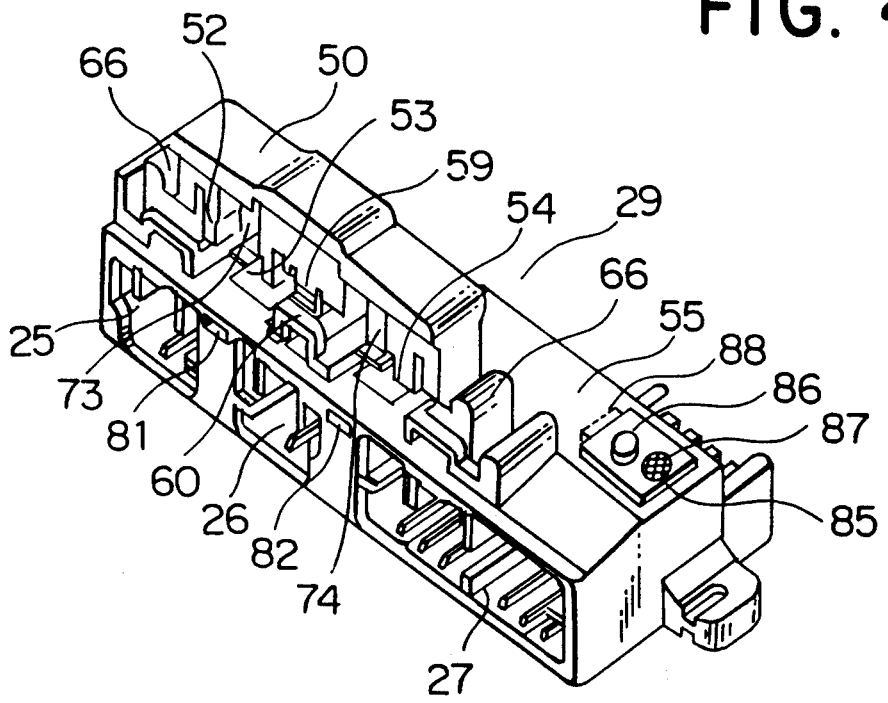
FIG. 4 is a perspective view of a pin connector provided with the detection lever in accordance with one embodiment of the present invention.
Figure 5:
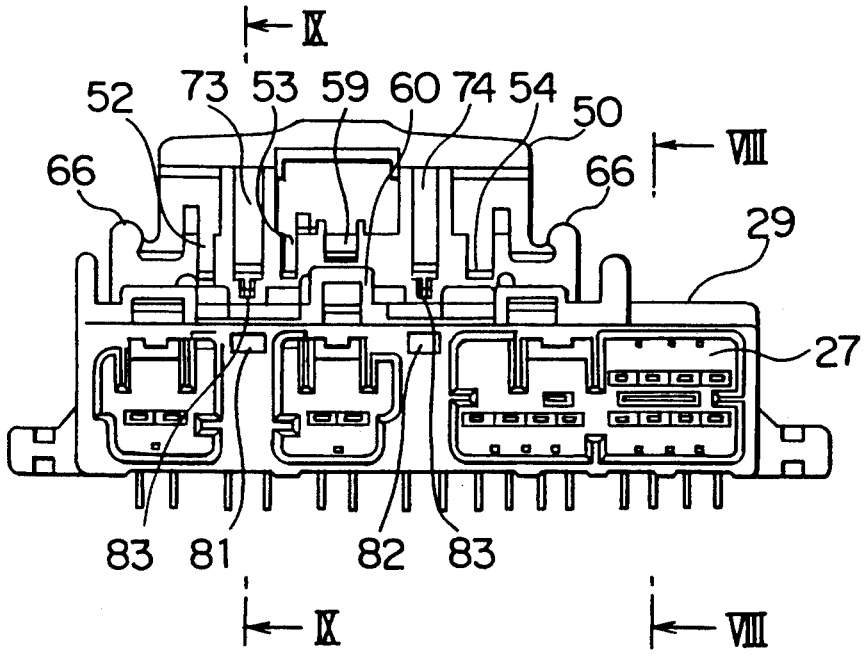
FIGS. 5 to 7 are front, top and side view of the pin connector shown in FIG. 4 before engagement of the detection lever.
Figure 6:
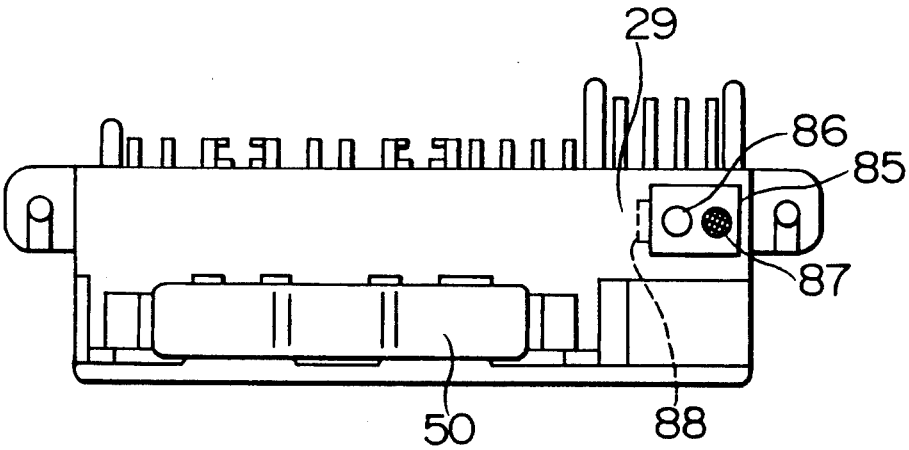
Figure 7:
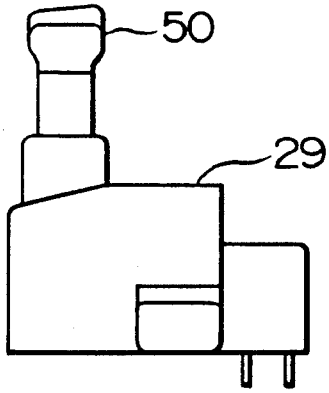
Figure 8:
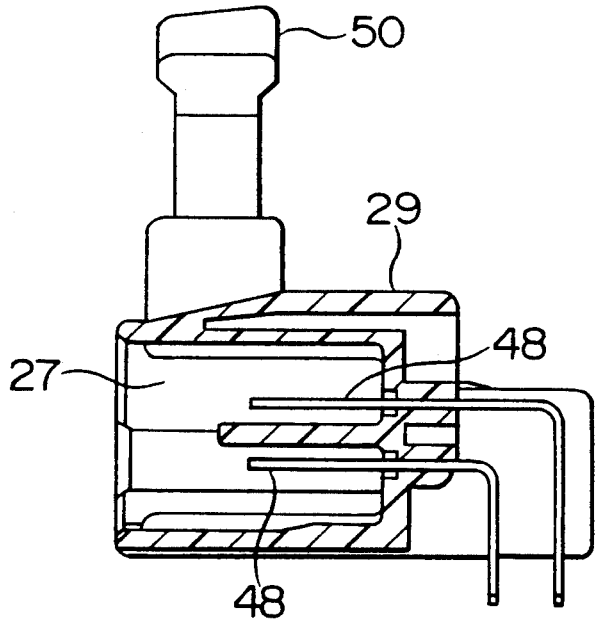
FIG. 8 is a cross-section taken along a line VIII—VIII in FIG. 5.

The battery 88, the switch indicator 85 including the lamp 86 and the buzzer 87 may be mounted in the pin connector as shown in FIG. 4. However, they may preferably be provided in a device associating the pin connector. In the case, they are connected with the switch contact 71 by cables.

Figure 13:
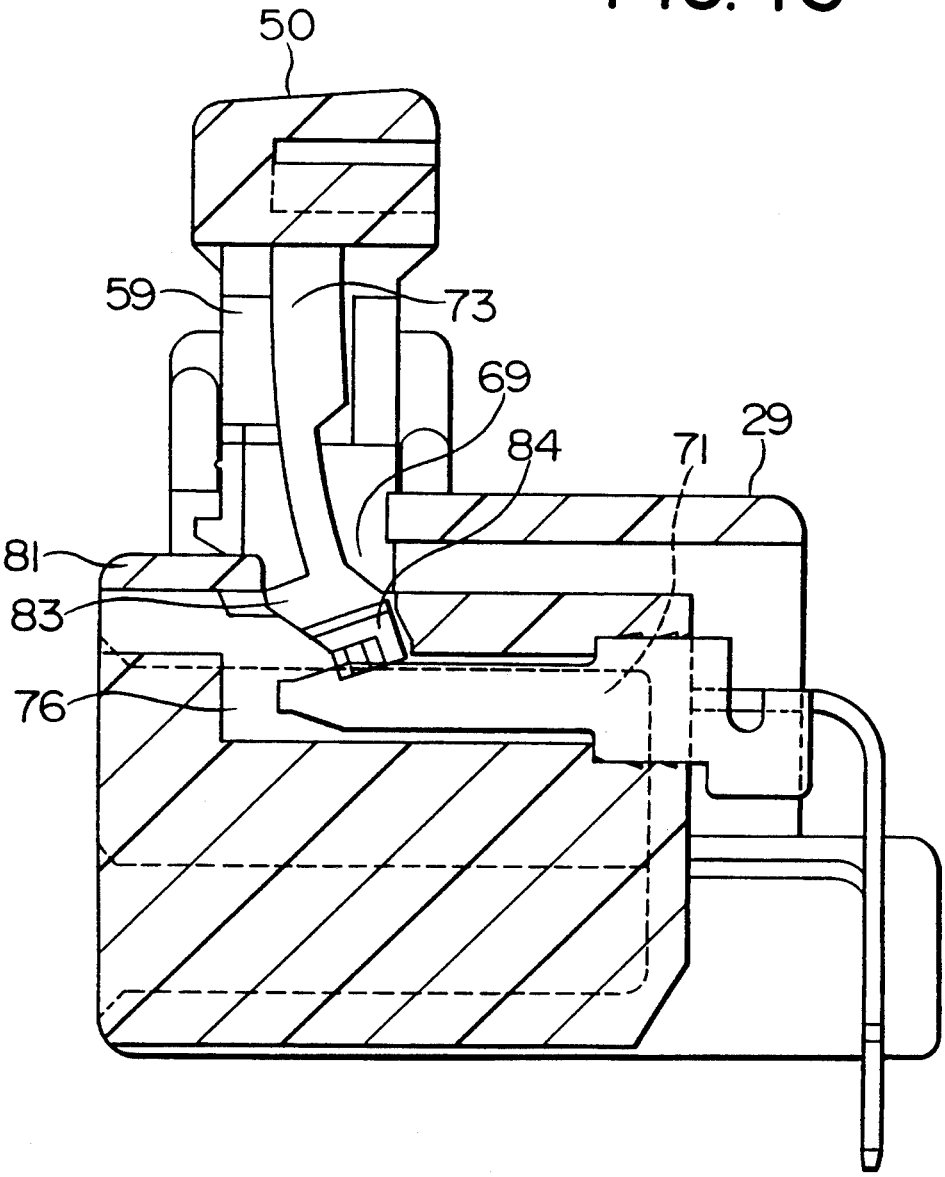
FIG. 13 is a cross-sectional view of the switch contact with the detection lever in FIG. 9 being just before engagement.
Figure 14:
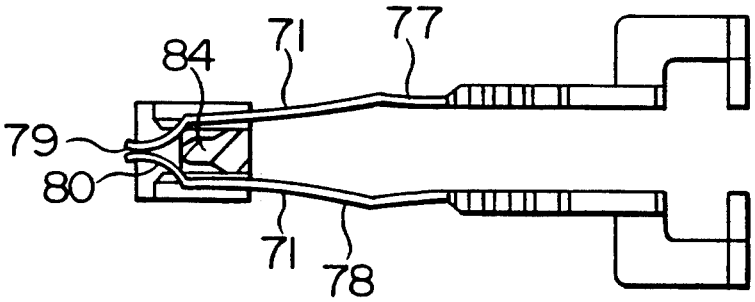
FIG. 14 is a cross-sectional view of the switch contact on the pin connector in a state just before engagement with the detection lever.

Incomplete connection of the connector 20 is shown in FIGS. 13 and 14.

In the condition shown in FIGS. 10 and 11, the release heads 84 of the push rods 73 and 74 intervene between the end contacts 79 and 80 of the switch contacts 71 to open the electric circuit shown in FIG. 12. This open state of the circuit indicates presence of the complete connection of the connector 20.

When the detection lever 50 is depressed in the position shown in FIGS. 10 and 11, the push rods 73 and 74 are brought into engagement with the hole ends 81 and 82 of the through hole 69, respectively. In this very position, the release heads 84 of the push rods 73 and 74 intervene between the end contacts 79 and 80 of the switch contact 71 to release them from mutual contact. By arranging a pair of the above-described mechanisms on the pin connector 29, the state of engagement of the detection lever 50 can be detected visually and audibly.

Figure 15:
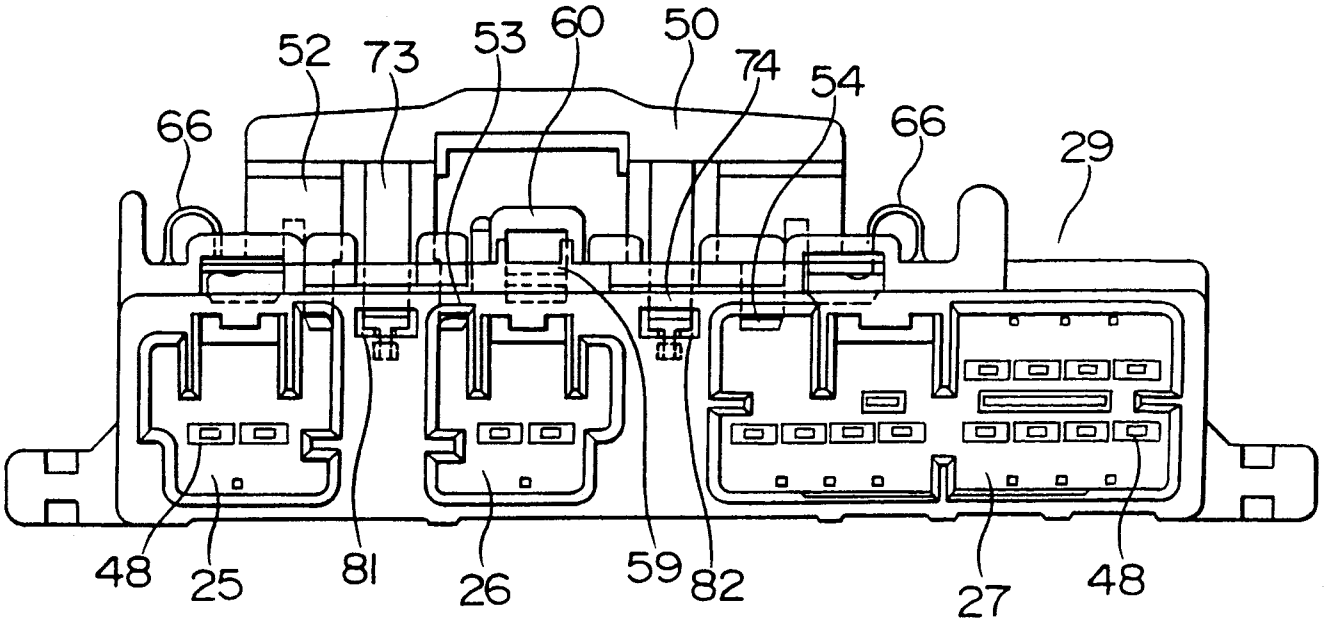
FIG. 15 is a front view of the pin connector with the detection lever in the correct engagement.
Figure 16:
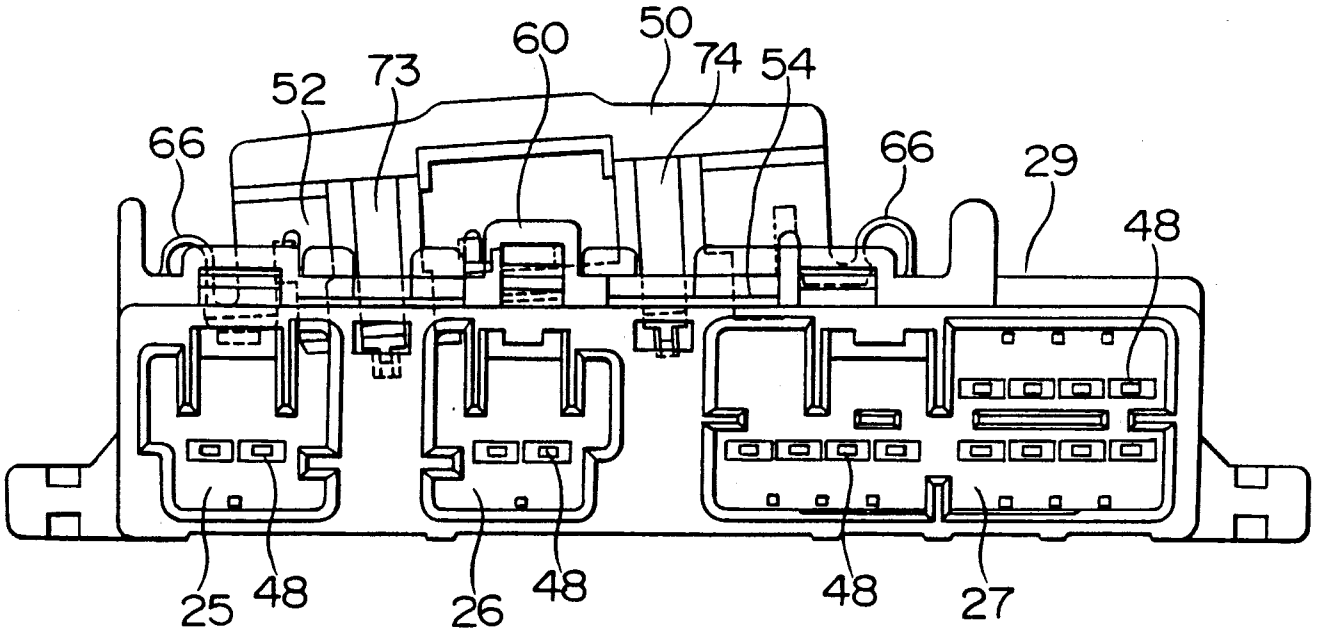
FIG. 16 is a front view of the pin connector with the detection lever in an incorrect engagement.

Under the condition shown in FIG. 15, the detection lever 50 is in the correct connection with the pin connector 29 and a pair of switch contacts 71 on the pin connector 29 accordingly detect and indicate this condition of connection with the associated electric circuits being both open. Whereas, under the condition shown in FIG. 16, only one push rod 73 is in engagement with the associated switch contact 71 and the other 74 out of engagement with the associated switch contact 71. That is, the detection lever 50 is in incorrect connection with the pin connector 29. Then, the electric circuit associated with the push rod 74 remains closed and, as a consequence, the switch indicator 85 detects and indicates the incorrect connection of the detection lever 50 with the pin connector 29. In other words, the lamp 86 remains turned on.

The unit comprised of the indicator 85, the lamp 86, the buzzer 87 and the battery 88 may be located separate from the pin connector 29 at any positions convenient for uses. Short circuiting may occasionally occur in the switch contacts 71 or the release heads 84 may not intervene between the end contacts 79 and 80 despite depression of the detection lever 50. Under these conditions, the electric circuits associating the switch contacts 71 are both closed so that the lamp 86 is turned on and the buzzer 87 is energized for visual and audible indication of the abnormal state in the system.

What is claimed is:

1. An improved electric connector comprising:

at least one socket connector;

a pin connector provided with at least one receiving hole adapted for receiving said socket connector;

a detection lever provided with a plurality of legs extending towards said receiving hole and coupled to said pin connector in an arrangement such that said legs should intrude into said receiving hole to rest in a corresponding recess formed in said socket connector when said socket connector is completely received in said receiving hole of said pin connector and said detection lever is depressed against said pin connector;

at least one pair of switch contacts arranged within said pin connector; and at least one push rod coupled to said detection lever so as to push and open said switch contacts, only when said detection lever is depressed and said socket connector is completely received in said receiving hole of said pin connector.

2. An improved electric connector as claimed in claim 1 in which:

said pin connector is provided with a cavity accommodating said switch contact and a through hole communicating with said cavity;

said push rod extends into said through hole;

said switch contact includes a pair of leaf springs and a pair of opposed end contacts carried by said leaf springs; and said push rod is provided with an engage 83 piece for engagement with hole 81 ends of said through hole as well as a release head which intervene between said end contacts when said detection lever is depressed.

3. An improved electric connector as claimed in claim 1 or 2 further comprising:

a lock unit for locking connection between said pin connector and socket connector.

4. An improved electric connector as claimed in claim 1 or 2 in which:

said switch contact is associated with an electric circuit; and said electric circuit includes an indicator provided with a lamp for indicating the state of said end contact of said switch contact.

5. An improved electric connector as claimed in claim 4 further comprising:

a lock unit for locking connection between said pin connector and socket connector.

6. An improved electric connector as claimed in claim 4 in which:

said electric circuit further includes a buzzer which is energized at closure of said end contacts of said switch contact.

7. An improved electric connector as claimed in claim 6 further comprising:

a lock unit for locking connection between said pin connector and socket connector.

* * * * *

UNITED STATES PATENT AND TRADEMARK OFFICE

CERTIFICATE OF CORRECTION

PATENT NO. : 5,062,806

DATED : November 5, 1991

INVENTOR(S) : Akira Ohno, et. al.

It is certified that error appears in the above-identified patent and that said Letters Patent is hereby corrected as shown below:

Column 6, lines 38 and 39, delete the number "83" and "81"
Column 6, line 53, "contact"(first occurrence) should be --contacts--

Signed and Sealed this

Twenty-fifth Day of May, 1993

*Attest:*

Michael K. Kirk

MICHAEL K. KIRK

*Attesting Officer*

*Acting Commissioner of Patents and Trademarks*